United States Patent [19]

Hall

[11] 3,967,713

[45] July 6, 1976

[54] SLIDE ACTUATOR AND MEANS CONTROLLING MOVEMENT OF SAME BETWEEN FULLY RETRACTED AND FULLY ADVANCED POSITIONS

[75] Inventor: Mitchell A. Hall, Fort Thomas, Ky.

[73] Assignee: Monarch Tool & Manufacturing Company, Covington, Ky.

[22] Filed: June 18, 1975

[21] Appl. No.: 587,902

[52] U.S. Cl. ..... 194/92

[51] Int. Cl.[2] ..... G07F 5/05

[58] Field of Search ..... 194/92, 55, 102, 93, 194/DIG. 12

[56] References Cited

UNITED STATES PATENTS 2,116,309 5/1938 Gorton ..... 194/92 X 3,912,063 10/1975 Hall ..... 194/92

*Primary Examiner*—Stanley H. Tollberg

*Attorney, Agent, or Firm*—J. Warren Kinney, Jr.

[57] ABSTRACT

A reciprocable slide actuator is movable between fully retracted and fully advanced positions, wherein a latch is selectively engageable with the slide actuator to preclude advancement thereof from a retracted position. Control means are selectively operable to disengage the latch from the slide actuator for permitting advancement of the slide actuator to the fully advanced position.

27 Claims, 11 Drawing Figures

FIG-5
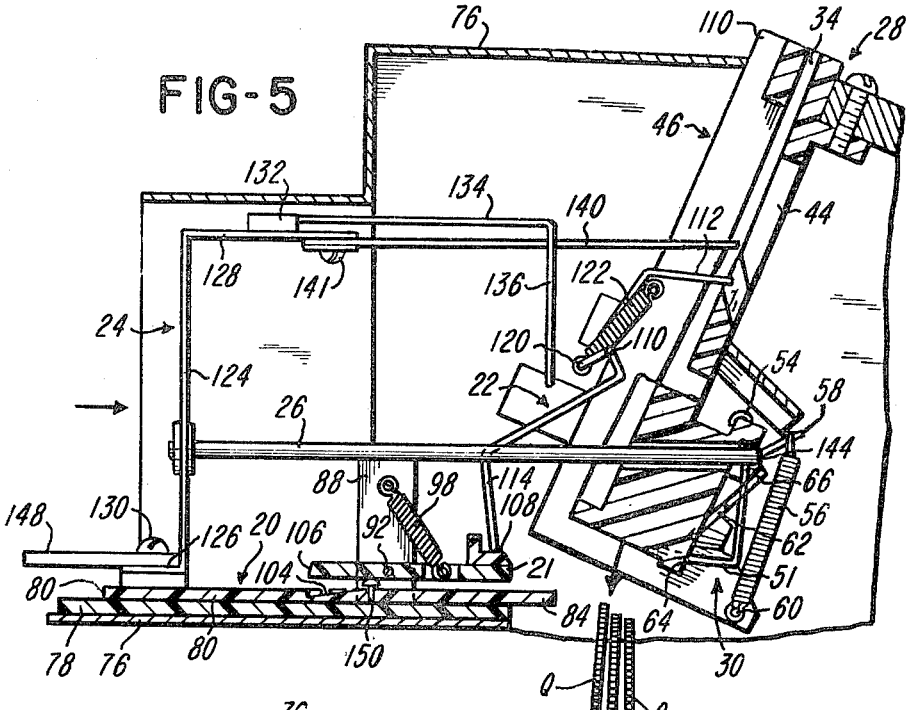
FIG-6
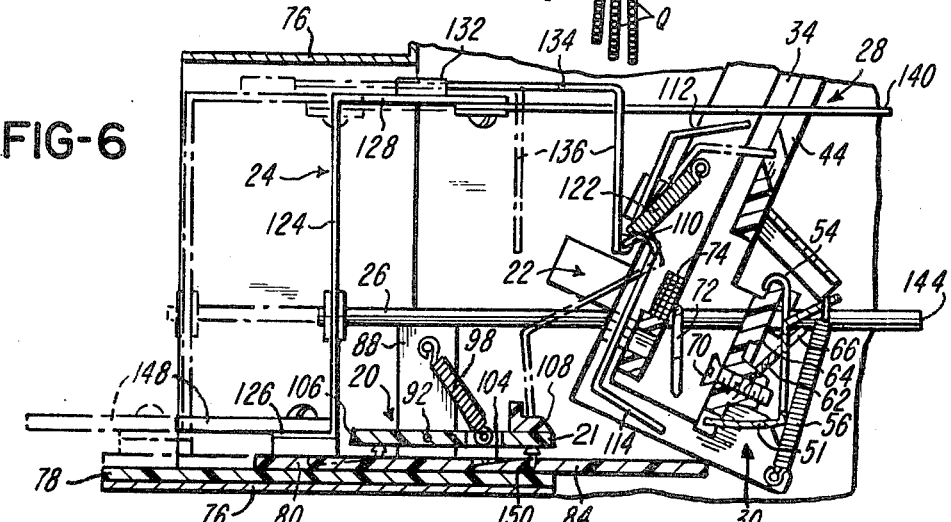
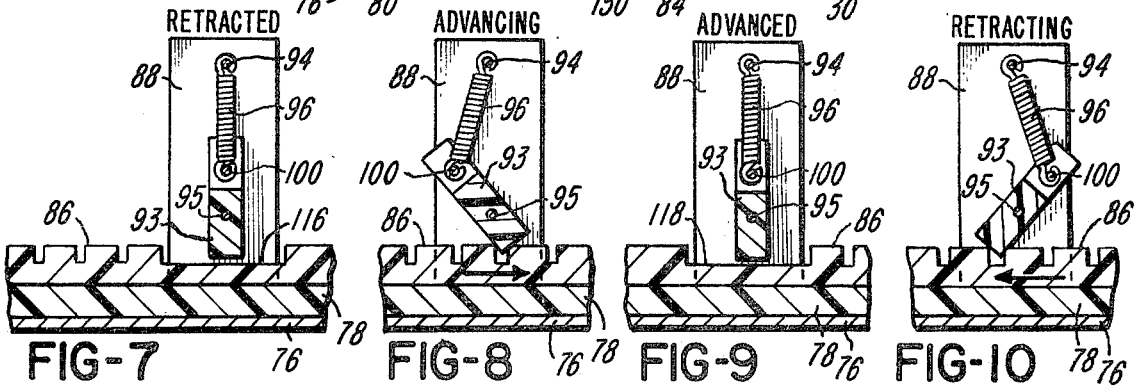
FIG-7 FIG-8 FIG-9 FIG-10

SLIDE ACTUATOR AND MEANS CONTROLLING MOVEMENT OF SAME BETWEEN FULLY RETRACTED AND FULLY ADVANCED POSITIONS

BACKGROUND OF THE INVENTION

1. Field of the Invention

The present invention is directed to a device for selectively controlling the movement of a slide actuator between fully retracted and fully advanced positions, wherein a latch member normally engages and precludes advancement of the slide actuator from a retracted position until fulfillment of a predetermined conditoin.

2. Description of the Prior Art

It is known to provide an actuator which is responsive to the fulfillment of a predetermined condition, such as, by way of example, the presence of a predetermined number of coins in a coin-chute, or the like, as shown in my copending application entitled: COIN ACTIVATED CIRCUIT CLOSING DEVICE, Ser. No. 446,234, filed Feb. 27, 1974, and assigned to the present assignee. The device of the present invention differs significantly from the circuit closing device which is disclosed therein.

SUMMARY OF THE PRESENT INVENTION

The device of the present invention includes a slide actuator which is movable between fully retracted and fully advanced positions, a latch selectively engageable with the slide actuator for precluding movement thereof from a retracted position, and a latch control member which is selectively operable to disengage the latch from the slide actuator for permitting advancement thereof to a fully advanced position.

Generally, the latch control member is operable to disengage the latch from the slide actuator in response to fulfillment of a predetermined condition.

Means are included for resetting the latch and control member once the slide actuator has been advanced to a fully advanced position. Further, means are included for precluding the fulfillment of the condition whenever the latch is disengaged from the slide actuator or whenever the slide actuator is in an advanced position.

In one embodiment, the device of the present invention may be utilized in combination with an accumulative coin-chute, wherein the latch control member is responsive to the presence of a predetermined number of coin-tokens in said coin-chute to shift the latch from engaging to disengaging relationship with the slide actuator. Means are secured to and carried by the slide actuator for releasing the accumulated coin-tokens and for resetting the control member for subsequent, repeated operation upon full advancement of the slide actuator, whereby the latch engages the slide actuator when it is returned to the fully retracted position and precludes movement of the slide actuator therefrom.

It is therefore, a primary object of the present invention to provide a device for selectively controlling a slide actuator.

Other objects and features of the present invention will be readily apparent from the drawings and from the detailed description which follows. BRIEF DESCRIPTION OF THE DRAWINGS FIG. 1 is an exploded perspective view and illustrates the various components of the device in combination with an accumulative inclined coin chute.

FIG. 5 is a view similar to FIG. 3 and illustrates the slide plate in a partially advanced position.

FIG. 6 is a view similar to FIG. 3 and illustrates the slide plate in the fully advanced position.

FIG. 7 is a sectional view taken on line 7—7 of FIG. 2 and illustrates the interrelationship of the pawl and ratchet members when the slide plate is fully retracted.

FIG. 8 is a view similar to FIG. 7 and illustrates the interrelationship of the pawl and ratchet members when the slide plate is advanced as in FIG. 5.

FIG. 9 is a view similar to FIG. 7 and illustrates the interrelationship of the pawl and ratchet members when the slide plate is fully advanced as in FIG. 6.

FIG. 10 is a view similar to FIG. 7 and illustrates the interrelationship of the pawl and ratchet members when the slide plate is partially retracted.

FIG. 11 is a sectional view taken on line 11—11 of FIG. 2 and illustrates the interrelationship of the pawl and ratchet members when the deactivated slide is advanced into the positive stop defined by the locked latch.

DESCRIPTION OF THE PREFERRED EMBODIMENT

Figure 1:
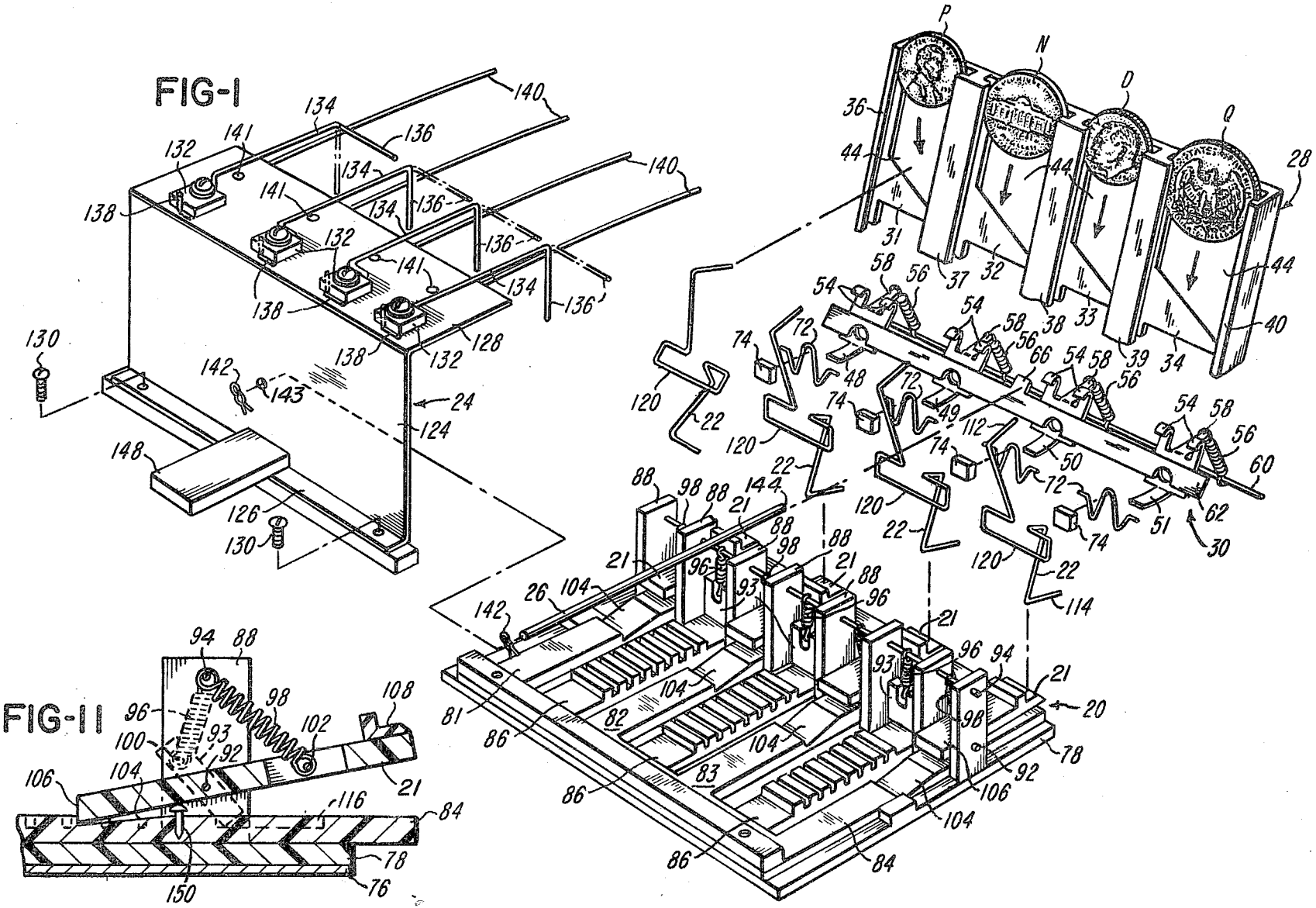

The device of the present invention comprises a slide actuator 20; at least one latch member 21 selectively engageable with the slide actuator; and at least one latch control member 22.

In the preferred form, the device includes means 24 for resetting the control member upon full advancement of the slide actuator, and, when the device is responsive to fullfilment of a predetermined condition, means 26 for negating the condition, once fulfilled, upon advancement of the slide actuator.

For ease of understanding, the device is illustrated and described in combination with a plurality of inclined coin-chutes 31–34, each of which includes means 30 for accumulating a predetermined number of coin-tokens which are inserted in the various coin-receptive channels of the coin-chutes. The predetermined condition is fulfilled when a predetermined number of coin tokens has been introduced in each of said coin-chutes.

The coin-chutes and accumulating means are not part of the present invention and an in depth description thereof is not included herein. It should, of course, be understood that the device of the present invention is readily adapted for use with known accumulative coin chutes such as, by way of example, the inclined coin chute shown and described in my aforementioned copending application, Ser. No. 446,234.

Generally, the coin-chutes are defined by a chute body 28 having a plurality of inclined coin receptive chute-defining channels 31, 32, 33 and 34 which are bounded by adjacent pairs of elongate ribs or side walls 36, 37, 38, 39 and 40. The chutes or channels 31–34 are adapted for receiving specific coin-tokens P, N, D, and Q, respectively. It will be noted that each chute includes an elongate, through slot or opening 44 through which rejected coin or slug-tokens are ejected.

Cover member 46 maintains the coin-tokens in continuous engagement with body 28 as the coins gravitationally advance in the respective coin chutes.

The accumulating means 30 is secured to and carried by chute body 28 (FIGS. 3–6) and includes shelves or abutments 48, 49, 50 and 51 which are in open communication with chutes 31–34, respectively. Each abutment is adapted for accumulating a specific, predetermined number of the coin-tokens which are deposited in the corresponding chutes 31–34. One abutment is pivotally secured to each chute at hinge 54 (FIG. 3) and is normally urged into the path of the advancing coin-tokens by tension spring 56, opposite ends of which are secured to the corresponding abutment at tab 58 and to the chute body at elongate rod 60.

Figure 4:
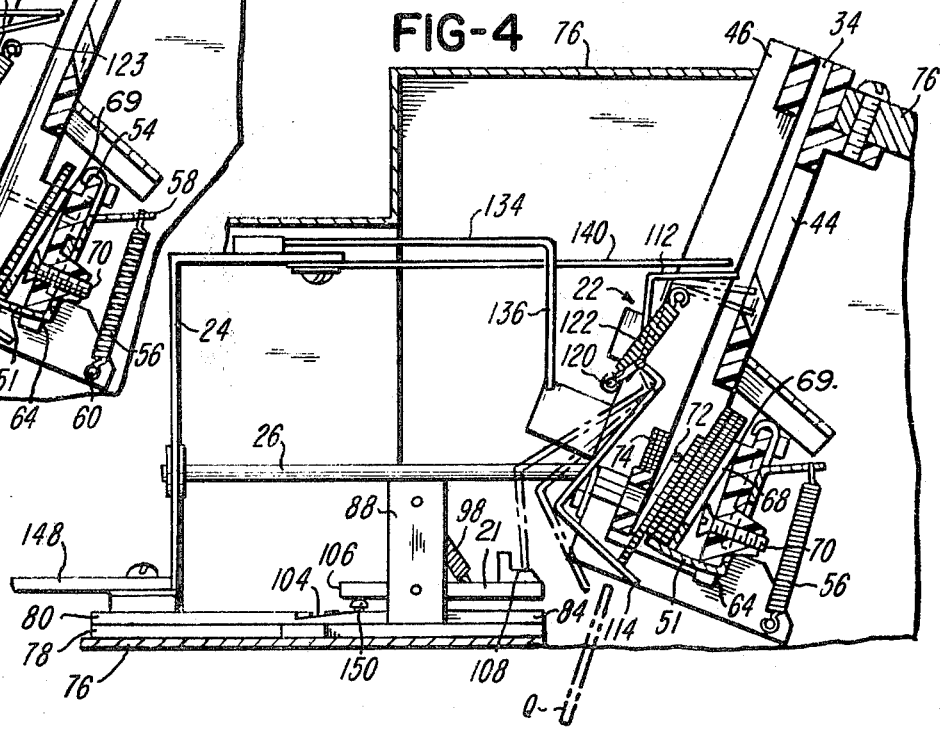
FIG. 4 is a view similar to FIG. 3 and illustrates the latch control means in the latch engaging, slide activating position.

Each abutment 48–51 includes a movable support 68 which is pivotally mounted relative to rear wall 64 of the chute body at 69 (FIG. 4). Set screw 70 is carried by and axially adjustable relative to wall 64 and defines a positive stop for accurately positioning each support 68 relative to the corresponding abutment 48–51 whereby the number of coin-tokens which may be accumulated at each abutment is readily and accurately controlled.

A plurality of wire guides 72 are pivotally mounted in cover member 46 and are normally urged toward the corresponding abutments 48–51 by magnets 74 or the like for guiding advancing coin-tokens into the abutments and for precluding the premature release of the coin-tokens from the accumulating means.

An elongate bar 62 (FIGS. 1, 5 and 6) is disposed intermediate the abutments 48–51 and wall 64 and includes an upwardly projecting tab 66 which is adapted to be engaged by forward end 144 of the elongate, actuator-defining rod 26. The advancing actuator effects pivotal movement of bar 62 outwardly from the rear wall of the chute body, wherein the bar translates the movement to abutments 48–51 for releasing the coin-tokens accumulated in chutes 31–34 (FIGS. 5 and 6).

The assembled coin chutes 31–34 are secured to and carried by suitable support structure such as, by way of example, frame 76.

THE SLIDE ACTUATOR AND LATCH MEMBER

Figure 2:
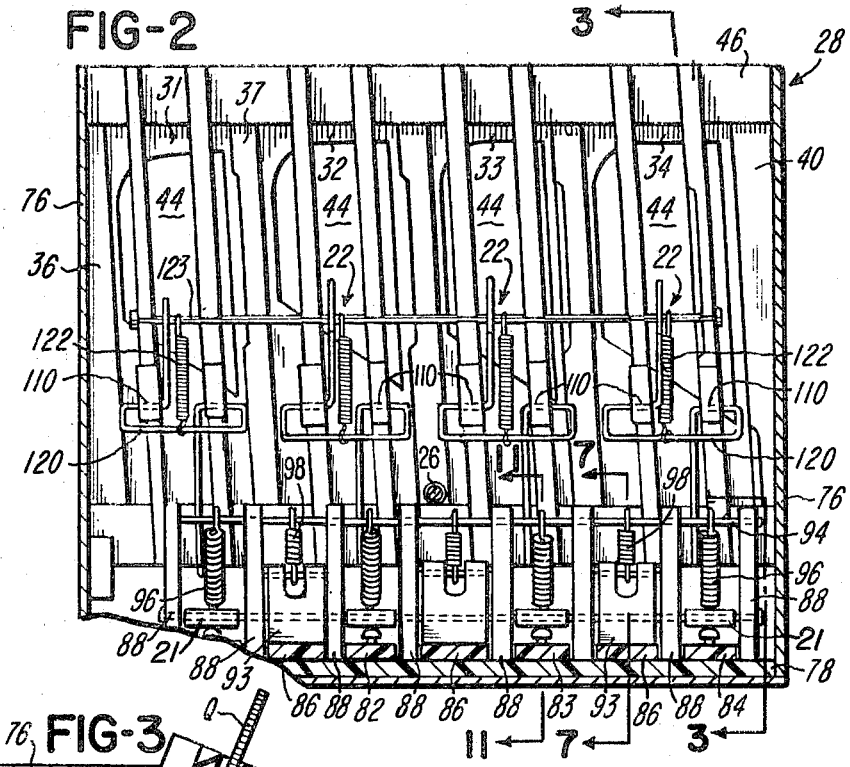
FIG. 2 is an elevational view, partially in section, showing the device and inclined coin chute.
Figure 3:
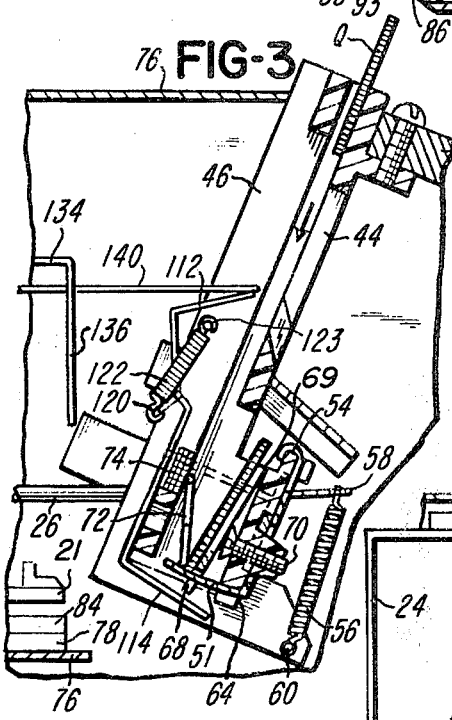
FIG. 3 is a sectional view taken on line 3—3 of FIG. 1 and illustrates the slide plate of the device in the fully retracted position.

The slide actuator 20 includes a flat, substantially horizontal base 78 which is fixedly secured to and carried by support frame 76 (FIG. 2) and slide plate 80 which is slidably carried by base 78 and is movable between the fully retracted position of FIGS. 1, 3 and 4 and the fully advanced position of FIG. 6 for controlling the movement of the reset member 24 and the release actuator 26. Slide plate 80 comprises a plurality of spaced, parallel, elongate slide members 81, 82, 83 and 84 which are in axial alignment with and are disposed in open communication with chutes 31–34, respectively. A plurality of elongate ratchet members 86 are secured to and carried by the slide plate 80 and are disposed intermediate adjacent slide members 81–84.

A plurality of elongate, upstanding posts 88 project from base 78 and are disposed intermediate the ratchet members 86 and the slide members 81–84 (FIG. 1). Elongate rod 92 is carried by posts 88 and is spaced upwardly from the slide plate. The rod provides means for pivotally mounting a plurality of alternating latches 21 and pawls 93, wherein each latch 21 is in communication with one slide member and each pawl 93 is in communication with one ratchet member, respectively.

A second elongate rod 94 is carried by posts 88 and is spaced upwardly from rod 92 for supporting the uppermost end of a plurality of tension springs 96 and 98 whereas the lower end of each spring 96 is secured to post 100 of the corresponding pawl 93 (FIGS. 7–9) and lower end of each spring 98 is secured to the post 102 of the corresponding latch 21 (FIG. 11).

Each of the slide members 81–84 includes a forwardly inclined, latch engaging notch 104 which is adapted for receiving the rearward end 106 of the corresponding latch 21. Springs 98 normally urge each latch 21 into positive engagement with notch 104 and preclude premature advancement of the slide plate 80, as shown in FIG. 11.

Post 150 projects upwardly from each slide member forwardly of notch 104 and is adapted for engaging end 106 of the corresponding latch when slide plate 80 is fully retracted (FIG. 4). The post establishes and maintains a fixed spaced relationship between the latch and the slide plate, whereby seat 108 of the latch is adapted to receive latch control 22 when a predetermined number of coin-tokens have been deposited in the corresponding chute (FIG. 4). Control 22 is operable in response to deposit of a predetermined number of coin-tokens in the corresponding chute to engage and unlock the latch for activating the slide member. When each of the slide members 81–84 are activated, full advancement of slide plate 80 may be accomplished (FIG. 6).

THE LATCH CONTROL

Each chute 31–34 includes a latch control 22 which is pivotally mounted in cover 46 at 110—110 (FIG. 2) and includes an upper, forwardly projecting finger 112 and a lower, rearwardly projecting finger 114. The latch control is shiftable between a first position wherein finger 112 is retracted from the path of advancing coin-tokens and finger 114 is disposed forwardly of the corresponding latch seat 108 (FIG. 3), and a second position wherein finger 112 is advanced into the path of advancing coin-tokens and finger 114 is disposed in abutting engagement with the latch seat (FIG. 5). When each finger 114 is in the second position and is in positive engagement with the corresponding seat 108, each latch 21 is unlocked and slide plate 80 is activated.

Each latch control is maintained in either the first or the second position by the corresponding over-center spring 122 secured at opposite ends to the latch control at cross-member 120 and the chute body.

THE RESET MEMBER

Reset member 24 comprises an upstanding plate 124 and filaments 134 and 140 which are secured to and carried by the plate. The plate includes a lower, rearwardly projecting base 126 and an upper, forwardly projecting deck 128, wherein the reset member is secured to and carried by slide plate 180 via suitable mounting means such as, by way of example, screws 130 or the like which are accommodated by base 126.

A plurality of mounting blocks 132 are secured to and carried by deck 128 for carrying the rotatable, stiff, wire-like filaments 134. Each filament projects forwardly from deck 128 and terminates in an integral, elongate, reset finger 136, wherein the rearward end of each filament terminates in a handle portion 138 which is adapted for rotating the filament relative to block 132 for shifting finger 136 between a depending, resetting position (see particularly FIGS. 3–6) and a horizontal, deactivated position as shown at chute 31 of FIG. 1.

A plurality of second elongate, wire-like filaments 140 or the like are secured to and carried by deck 128 at 141 and are parallel to and spaced downwardly from corresponding first filaments 134. Each pair of filaments 134 and 140 is disposed in open communication with the corresponding coin-chute 31–34 when the device of the present invention and coin-chutes 31–34 are fully assembled.

When each finger 136 is in the depending, resetting position and the slide plate 80 is fully advanced (FIG. 6), each finger engages cross-member 120 of the corresponding latch control 22 and shifts said control from the second position (FIG. 5) to the first position (FIG. 3). Second filament 140 is advanced into the corresponding coin-chute for intercepting and ejecting any coin-tokens which are deposited in the chute when the slide plate is in the advanced position.

An elongate bar 148 is secured to and carried by plate 124 and diagrammaticly illustrates means for coupling the slide plate 80 to a suitable actuating handle or the like (not shown) for controlling the advancement and retraction of the slide plate and reset member relative to base 78 and frame 76. It should, of course, be understood that slide plate 80 or any of the various components which are movable therewith may be secured to an actuator mechanism for controlling the operation of a vending machine or the like in response to movement of the slide plate from the fully retracted to the fully advanced position.

THE COIN-TOKEN RELEASE ACTUATOR

The coin-token release actuator comprises an elongate rod 26 which is secured to, carried by and projects outwardly from the upstanding plate 124 of reset member 24. The rearward end of the actuator is received by mounting hole 143 in plate 124 and is secured thereto by suitable means such as, by way of example, spring retainers 142, 142 (FIG. 1). The forward end 144 of the actuator is adapted for abuttingly engaging and pivotally advancing tab 66 of bar 62 when the slide plate 80, reset member 24 and actuator rod 26 are advanced to the position of FIG. 5.

OPERATIONAL MODE

Initially, slide plate 80 is fully retracted and each latch control 22 is set in the first, latch locking, slide deactivating position (FIG. 3). Each accumulating means 30 is adjusted to accumulate one less than a selected, predetermined number of coin-tokens by setting each screw 70 relative to wall 64 (FIG. 4). In the preferred embodiment, each abutment 48–61 may be independently set to retain and accumulate from zero to three coin-tokens.

Where desired, certain of the chutes may be set to receive zero coin-tokens by presetting the corresponding latch control 22 in the second position and by indexing the corresponding reset finger 136 to the horizontal, deactivated position. As shown at chute 31 of FIG. 1, any coin-token P which is inserted in the chute 31 is intercepted by the advanced upper finger 112 of the latch control and is ejected from the coin chute through slot 44. Since the latch control is in the second position, latch 21 of chute 31 is always unlocked and the corresponding slide member 81 is always activated.

One less than a selected predetermined number of coin-tokens are deposited in each operable chute 32–34 and are accumulated at the corresponding abutment 49–51 in the manner described in my aforementioned copending application, Ser. No. 446,234. The coin-token which is next deposited in each coin chute will equal the selected predetermined number therefor. Said coin-token will bypass the abutment and strike the advanced lower finger 114 of the corresponding latch control 22, whereby the control is shifted from the first to the second position (see FIG. 4).

Referring specifically to FIGS. 3 and 4, it will be seen that abutment 51 is set to accumulate and retain three coin-tokens Q. When the fourth coin-token Q is inserted in Chute 34, it bypasses the abutment, strikes finger 114 (FIG. 4) and shifts control 22 to the second, latch unlocking, slide activating position, wherein finger 112 is in interferring relationship with chute 34 and finger 114 engages seat 108 of the corresponding latch 21 (FIGS. 4 and 5). Finger 112 intercepts any additional coin-tokens which are inserted in chute 34 and ejects some through slot 44.

After the predetermined number of coin-tokens N, D and Q have been deposited in each of the chutes 32–34, each latch control 22 is shifted to the second position, each slide member 81–84 is unlocked, whereby slide plate 80 is free to be advanced from the fully retracted position of FIGS. 2, 3 and 4. When slide plate 80 is partially advanced to the position of FIG. 5, the forward end 144 of actuator 26 engages tab 66 of bar 62 and pivotally advances the bar outwardly from wall 64 of the coin-chute. Bar 62 translates the pivotal movement to abutments 48–51 and unloads the coin-tokens which are there accumulated (FIG. 5). Continued advancement of slide plate 80 advances activated reset fingers 136 into engagement with the cross-member 120 of corresponding latch control 22 and shifts the control from the second back to the first position (FIG. 6).

When the slide plate is advanced to the positions of FIGS. 5 and 6 it will be noted that the projecting filaments 140 are advanced into chutes 31–34 for intercepting and ejecting any coin-tokens which are thereafter deposited in the chutes. This precludes the insertion of coin-tokens in said chutes during the time when the latch controls 22 are reset but slide plate 80 is not fully retracted.

When the slide plate 80 is returned to the fully retracted position of FIGS. 2 and 3, the accumulating means of chutes 32–34 are reset to receive and accumulate the selected number of coin-tokens and ends 106 of the corresponding latches 21 lock and deactivate slide-members 82–84.

As illustrated in FIGS. 7-10, the pawl and ratchet members 92 and 86, respectively, effectively control the advancement and retraction of the unlocked slide plate 80. When the slide plate 80 is in the fully retracted position of FIGS. 2 and 3, pawl member 92 is resiliently urged into the elongate clearance notch 150 in ratchet 86 by spring 96 and is disposed in an upright, substantially vertical or neutral position (FIG. 7). As the slide is advanced, the ratchet teeth engage the lower end of pawl 92, and shift the pawl toward chutes 31–34, whereby the pawl precludes retraction of slide plate 80 but readily permits the unrestricted advancement thereof (FIG. 8).

When the slide plate is in the fully advanced position of FIG. 6, a second elongate clearance notch 52 receives pawl 92 and permits spring 96 to return the pawl to the neutral or vertical position. As the slide plate is retracted from the fully advanced position, the pawl again engages the teeth of ratchet 86 and is shifted away from chutes 31–34, whereby the pawl precludes advancement of the slide plate but readily permits the unrestricted retraction thereof.

It should, of course, be understood that elongate notch 150 is of sufficient length to readily accommodate pawl 92 in the event of attempted, premature advancement of the slide plate from the fully retracted position when rearward end 106 of any of the latches 21 is in locking engagment with notch 104 of the corresponding slide member 81–84 (FIG. 11).

What is claimed is:

1. A device of the class described, comprising:

an elongate slide actuator reciprocably mounted for movement between fully retracted and fully advanced positions, said actuator including latch means intermediate its length;

an elongate latch member, having front and rear ends, said member pivotally mounted for movement of the rear end thereof between interfering and non-interfering positions relative to the latch means of said slide actuator;

means yieldably urging the rear end of said latch member into engagement with the latch means of the slide actuator for precluding movement thereof from retracted to advanced positions;

an upwardly projecting abutment on said slide in advance of said latch means engaging the undersurface of said latch member when the side actuator is in a fully retracted position for positioning and maintaining the rear end of the latch member out of engagement with the latch means of the slide actuator; and a latch control member mounted for movement between interfering and non-interfering positions relative to the front end of the latch member, said latch control member, when in interfering relationship with the front end of the latch member, maintaining the rear end of the latch member out of engagement with the latch means of the slide actuator, thereby permitting movement of the slide actuator from retracted to a fully advanced position.

2. A device as called for in claim 1, wherein the latch means comprises a notch or recess in the upper surface of the slide actuator.

3. A device as called for in claim 1, wherein the latch control member is precluded from movement to interfering relationship with the front end of the latch member whenever the rear end of the latch member is in interfering relationship with the latch means of the slide actuator.

4. A device as called for in claim 1, which includes means selectively operable to shift the latch control member from a non-interfering to an interfering relationship with the front end of the latch member; and means operable to return the latch control member from an interfering to a non-interfering relationship.

5. A device as called for in claim 4, wherein said second mentioned means is inoperable until after said first mentioned means has been rendered operable.

6. A device as called for in claim 5, wherein said second mentioned means is inoperable until the latch means of the said slide actuator has been advanced forwardly of the rear end of the latch member.

7. A device as called for in claim 4, wherein said first mentioned means is operable only in response to the fulfillment of a predetermined condition.

8. A device as called for in claim 7, wherein said predetermined condition can be fulfilled only when the last means of said slide actuator is disposed rearwardly of the rear end of said latch member.

9. A device as called for in claim 4, wherein said second mentioned means is inoperable until fulfillment of said predetermined condition, and thereafter remains inoperable until the latch means of said slide actuator has been advanced forwardly of the rear end of the latch member.

10. A device as called for in claim 4, wherein said first mentioned means is rendered inoperable when said second mentioned means is rendered operable, and thereafter remains inoperable until the latch means of said slide actuator has been retracted rearwardly of the rear end of the latch member and until said predetermined condition is fulfilled.

11. A device as called for in claiam 4, wherein said means for returning the latch control member from interfering relationship to non-interfering relationship is secured to, carried by and movable with said slide actuator to engage and shift the latch control member incident to advancement of the slide actuator.

12. A device as called for in claim 1, which includes a plurality of latch means in said slide actuator, a plurality of latch members in one-to-one correspondence with said latch means, and a plurality of latch control members in one-to-one correspondence with said latch members, wherein all of said latch control members must be in interfering relationship with the front end of their corresponding latch members before the slide actuator can be moved to a fully advanced position.

13. A device as called for in claim 12, wherein each of said latch control members is responsive to fulfillment of a distinct and individual predetermined condition.

14. A device as called for in claim 12, wherein said latch control members are adapted to be selectively preset in continuous interfering relationship with the front end of their corresponding latch member.

15. A device as called for in claim 1, wherein said slide actuator is freely movable between a fully retracted position and a partially advanced position determined by engagement of the rear end of the latch member with the latch means of the slide actuator.

16. A device as called for in claim 15, which includes means operable when the latch means of the slide actuator is disposed forwardly of the rear end of the latch member to preclude retraction of the slide actuator, once advanced, from a less than fully advanced position and to preclude advancement of the slide actuator, once retracted, from a position wherein said latch means is forwardly of the rear end of the latch member.

17. A device as called for in claim 1, wherein movement of said latch control member from non-interfering to interfering positions relative to the latch member is responsive to the fulfillment of a predetermined condition as determined by the introduction of a predetermined number of coin-tokens into a coin chute.

18. A device as called for in claim 17, wherein the latch control member comprises an elongate relatively rigid filament including free upper and lower outer ends, wherein said lower end is movable between interfering and non-interfering relationship with the front end of the latch member.

19. A device as called for in claim 18, wherein the coin chute is inclined for gravitationally advancing coin-tokens from an upper, coin-receptive end to a lower, coin-discharge end, wherein the free, lower end of the filament, when in non-interfering relationship with the front end of the latch member, is disposed in the path of advancing coin-tokens, and wherein an advancing coin-token, upon striking said lower end of the filament, shifts the said lower end from non-interfering to interfering relationship with the front end of the latch member.

20. A device as called for in claim 19, which includes means in advance of the lower end of the filament for releasably accumulating and retaining one less than a predetermined number of the coin-tokens which are introduced in said coin-chute, wherein the next coin-token introduced in said coin-chute, after one less than a predetermined number have been accumulated and retained in said means, strikes and shifts the lower end of the filament from non-interfering to interfering relationship with the front end of the latch member.

21. A device as called for in claim 20, which includes means operable to release the accumulated coin-tokens incident to advancement of the latch means of the slide actuator to a position forwardly of the rear end of the latch member.

22. A device as called for in claim 21, wherein said accumulating means comprises a shelf mounted for pivotal movement between a coin-token intercepting and retaining position and a coin-token releasing position, and means yieldably urging said shelf into coin-token intercepting and retaining position; and wherein the said means to release the accumulated coin-tokens comprises an elongate abutment secured to and carried by the slide actuator and adapted to engage and pivot said shelf from a coin-token retaining to a coin-token releasing position.

23. A device as called for in claim 22, which includes means secured to and carried by the slide actuator for engaging the filament and shifting the lower end thereof from interfering to non-interfering relationship with the front end of the latch member after the accumulated and retained coin-tokens have been released from said shelf.

24. A device as called for in claim 20, wherein said coin-chute includes a coin-token reject aperture in advance of said accumulating means for ejecting unacceptable coin-tokens from the coin-chute, and wherein the free upper end of said filament is movable between coin-token intercepting and non-intercepting positions, adjacent said reject aperture, wherein, said free upper end of the filament is moved from a non-intercepting to an intercepting position when the free lower end of the filament is moved from non-interfering to interfering relationship with the front end of the latch member for intercepting and deflecting into the reject aperture coin-tokens which are thereafter introduced in said coin-chute.

25. A device as called for in claim 24, which includes means secured to and carried by said slide actuator and movable between a coin-token non-intercepting position when said slide actuator is in a fully retracted position and a coin-token intercepting position adjacent said reject aperture when the latch means of the slide actuator is advanced forwardly of the rear end of the latch member, for intercepting and deflecting into the reject aperture coin-tokens which are thereafter introduced in said coin-chute.

26. A device of the class described, comprising:

an elongate, manually operable slide actuator mounted for movement between fully retracted and fully advanced positions, said slide actuator having an upper surface including a notch intermediate the length thereof;

an elongate lever having front and rear ends and a substantially smooth under surface, said lever piovtally mounted for movement between interfering and non-interfering positions relative to the slide actuator;

means yieldably urging the rear end of said lever into engagement with the notch in said slide actuator for precluding movement thereof from retracted to advanced positions;

a post secured to, carried by and projecting upwardly from said slide actuator in advance of said notch, engaging the under surface of said lever when the slide actuator is in a fully retracted position for maintaining the rear end of the lever above and out of engagement with said notch;

an elongate control member mounted for pivotal movement above and forwardly of the front end of said lever, said control member including a free outer end adapted for movement between positions of non-engagement and engagement with the front end of said lever for selectively maintaining the rear end of the lever above and out of engagement with the notch in said slide actuator, thereby permitting movement of the slide actuator from a fully retracted to a fully advanced position;

means operable to shift the outer end of the control member from a position of non-engagement to a position of engagement with the front end of the lever in response to fulfillment of a predetermined condition; and an elongate abutment secured to and carried by said slide actuator for engaging said control member and shifting the outer end thereof from a position of engagement to a position of non-engagement with the front end of the lever incident to movement of the notch in said slide actuator forwardly of the rear end of the lever.

27. A device as called for in claim 26, which includes:

an inclined coin-chute disposed in communication with said control member and said slide actuator for gravitationally advancing coin-tokens from an upper coin-receptive end to a lower, coin-discharge end, wherein the free outer end of the control member is in the path of advancing coin-tokens when in non-engagement with the front end of said lever;

means in said coin-chute in advance of the lower end of the control member for releasably accumulating one less than a predetermined number of coin-tokens introduced in the coin-chute, wherein said predetermined condition is fulfilled when a coin-token is introduced in said coin-chute after one less than a predetermined number of coin-tokens have been accumulated therein, said coin-token striking the free outer end of the control member and shifting same from a position of non-engagement to a position of engagement with the front end of the lever;

said slide actuator including means for releasing the accumulated coin-tokens from the coin-chute when the notch in the slide actuator is advanced forwardly of the rear end of the lever.

* * * * *